US011231242B1

(12) United States Patent
Davis

(10) Patent No.: US 11,231,242 B1
(45) Date of Patent: Jan. 25, 2022

(54) MODULAR SYSTEM FOR FIREARM RECEIVER

(71) Applicant: Exponential Innovation IP Holdings LLC, Freehold, NJ (US)

(72) Inventor: Von Davis, Freehold, NJ (US)

(73) Assignee: Exponential Innovation IP Holdings LLC, Freehold, NJ (US)

( * ) Notice: Subject to any disclaimer, the term of this patent is extended or adjusted under 35 U.S.C. 154(b) by 0 days.

(21) Appl. No.: 17/111,952

(22) Filed: Dec. 4, 2020

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41C 23/02
USPC ..... 42/75.03, 90, 85
See application file for complete search history.

(56) References Cited

U.S. PATENT DOCUMENTS 10,598,450 B1 3/2020 Welch et al.

OTHER PUBLICATIONS

Spike's Tactical, "ST22 Pistol Plug", Web, Retrieved Dec. 4, 2020, <https://spikestactical.com/collections/lower-parts/st22-pistol-plug/>, (4 screen shots provided).

*Primary Examiner* — Reginald S Tillman, Jr.
(74) *Attorney, Agent, or Firm* — Lerner, David, Littenberg, Krumholz & Mentlik, LLP

(57) ABSTRACT

A modular system for a firearm receiver which has a threaded annulus at a rear end thereof. The modular system includes a base that includes a front face, a rear face, and a thread helically extending along an exterior thereof between the front face and rear face and configured to engage with the threaded annulus of the receiver. The base includes a screw opening extending through the front and rear faces. The system also includes a screw and a first end cap. The first end cap has a body. The body has a front face and a threaded opening extending into the body and terminating therein. The screw has a threaded shank configured to extend through the screw opening of the base and into the threaded opening of the first end cap for connecting the base and first end cap.

19 Claims, 10 Drawing Sheets

MODULAR SYSTEM FOR FIREARM RECEIVER

BACKGROUND OF THE INVENTION

The AR-15 platform is one of the most popular firearm platforms in existence. This platform generally includes an upper receiver, a lower receiver, and a bolt carrier group. The lower receiver includes a buffer tube that is threadedly connected to an end of the lower receiver and extends therefrom. The buffer tube houses a buffer and buffer spring which assists in the reciprocating action of the bolt-carrier group. A stock or arm-brace is typically integral with or mounted to the buffer tube which can help manage recoil and provide stability to the user. In recent years, certain modifications to the AR-15 platform have moved the reciprocating action from the buffer tube to be entirely contained within the upper receiver, such as, for example, in a .22 Long Rifle ("LW") conversion, thereby rendering the buffer tube non-functional in those configurations. This has allowed the buffer tube to be removed which has opened the door to further modifications. Therefore, further improvements are desirable.

BRIEF SUMMARY OF THE INVENTION

In one aspect of the present disclosure, a modular system for a firearm receiver that has a threaded annulus at a rear end thereof includes a base. The base has a front face, a rear face, and a thread that helically extends along an exterior thereof between the front face and rear face and is configured to engage with the threaded annulus of the receiver. The base has a screw opening that extends through the front and rear faces. The system also includes a screw and a first end cap that has a body. The body has a front face and a threaded opening that extends into the body and terminates therein. The screw has a threaded shank that is configured to extend through the screw opening of the base and into the threaded opening of the first end cap for connecting the base and the first end cap.

Additionally, the screw opening may be a smooth bore that has a first portion and a second portion. The second portion may have a cross-sectional dimension smaller than the first portion. The base may include a pin opening that may extend therethrough from the front face to the rear face. The first end cap may include a pin opening that may extend into the body from the front face thereof and may terminate within the body. The pin opening of the first end cap may be configured to align with the pin opening of the base when the base and first end cap are connected by the screw. The body of the first end cap may be disc shaped and the front face of the first end cap may have a maximum diameter smaller than a maximum diameter of the body so as to form a circumferential recess in a perimeter of the body.

Continuing with this aspect, the system may also include an endplate that has a plate body and a plate annulus extending from the plate body. The plate annulus may be receivable in the circumferential recess of the body of the first end cap and may define a plate opening that is configured to receive the front face of the first end cap. The first end cap may include a notch that may extend into the body and front face thereof. The endplate may include a tab extending into the plate opening. The tab may be receivable within the notch. Also, the first end cap may include a boss that extends from the front face thereof. The threaded opening may extend into the boss.

Further, the system may also include a second end cap that has a body. The body of the second end cap may have a front face and a threaded opening that may extend into the body of the second end cap and may terminate therein. The first end cap may include a Picatinny rail that may extend from a rear of the body of the first end cap. The second end cap may include an accessory boss that may extend from a rear of the body of the second end cap. The system may further comprise a third end cap that may have a body. The body of the third end cap may have a front face and a threaded opening that may extend into the body of the third end cap and may terminate therein. The body of the third end cap may have a sheer rear face. The base may include a ball-detent projecting from the front face thereof.

In another aspect of the present disclosure, a modular system for a firearm receiver that has a threaded annulus at a rear end thereof includes a base. The base has a front face, a rear face, and a thread that helically extends along an exterior thereof between the front face and rear face and is configured to engage with a threaded annulus of a firearm receiver. The base has a through opening that extends through the front and rear faces. The system also includes a first end cap that has a front side and a rear side. The front side has a blind opening that extends into the first end cap from the front side and terminates within the first end cap. The base and first end cap are connectable via one of a screw and pin extending through the through opening of the base and into the blind opening of the first end cap.

Additionally, the through opening may be a counterbore and the blind opening may be a threaded opening. The through opening and blind opening may each be smooth bores. The first end cap may include a body that may have a front face, and a boss may extend from the front face. The blind opening may extend into the boss. The through opening of the base may have a first portion and a second portion. The first portion may be closer to the front face of the base than the second portion. The second portion may have a smaller cross-sectional dimension than the first portion and may be dimensioned to receive the boss therein. The first end cap may include a Picatinny rail disposed at the rear side thereof.

Continuing with this aspect, the system may further include a second end cap that has a front side and a rear side. The front side of the second end cap may have a blind opening that may extend into the second end cap from the front side and may terminate within the second end cap. The rear side of the second end cap may have an accessory boss and an accessory opening that may extend therein. The system may also include an end plate that may have a plate body and a plate annulus. The front side of the first end cap may have a front face that may be configured to be received within the plate annulus and a circumferential groove that may be configured to receive the plate annulus.

In a further aspect of the present disclosure, a modular system for a firearm receiver having a threaded annulus at a rear end thereof includes a base. The base has a front side, a rear side, and a thread that helically extends along an exterior thereof between the front side and rear side and is configured to engage with a threaded annulus of a firearm receiver. The system also includes a first end cap and a second end cap. The first end cap has a front side and a rear side. The front side of the first end cap is connectable to the rear side of the base. The rear side of the first end cap has a first accessory means. The second end cap has a front side and a rear side. The front side of the second end cap is connectable to the rear side of the base. The rear side of the second end cap has a second accessory means. The second accessory means differs from the first accessory means.

BRIEF DESCRIPTION OF THE DRAWINGS

The features, aspects, and advantages of the present invention will become better understood with regard to the following description, appended claims, and accompanying drawings in which:

DETAILED DESCRIPTION

Figure 1A:
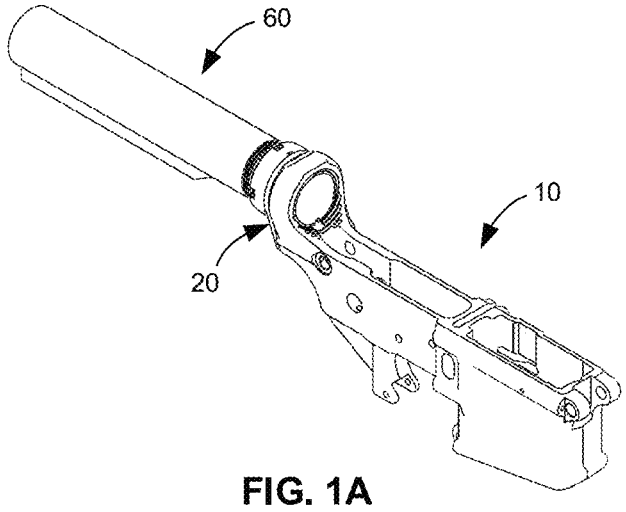
FIG. 1A is a perspective view of a lower receiver of a firearm according to an embodiment of the present disclosure having a buffer tube and receiver endplate mounted thereto.
Figure 1B:
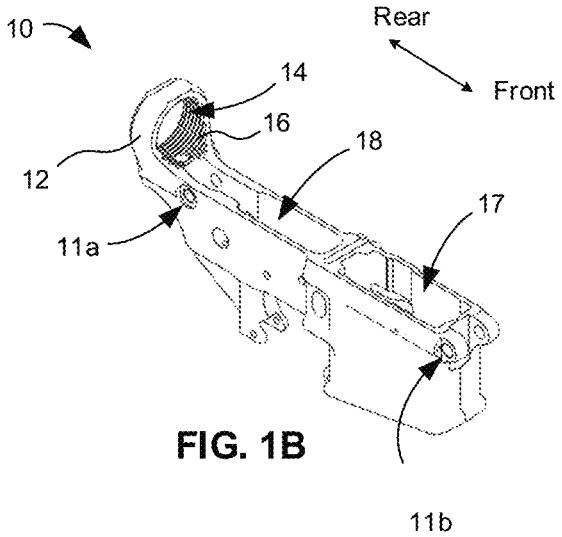
FIG. 1B is a perspective view of the lower receiver of the firearm without the buffer tube.
Figure 1C:
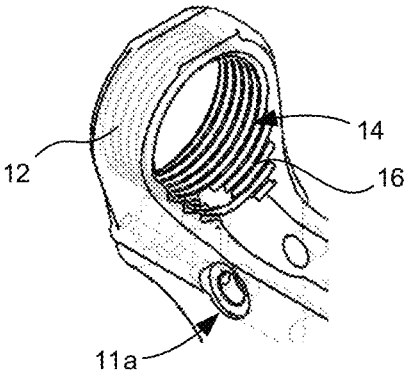
FIG. 1C is an enhanced perspective view of a rear end of the lower receiver of FIG. 1B.

FIG. 1A depicts a firearm lower receiver 10 according to an embodiment of the disclosure with a receiver extension or buffer tube 60 and receiver endplate 20 mounted thereto. Modifications may be made to the firearm which may render buffer tube 60 nonfunctional allowing for its removal. FIGS. 1B and 1C depict lower receiver 10 with buffer tube 60 removed. Lower receiver 10 is adapted to mate with an upper receiver (not shown), as is understood in the art. In this regard, lower receiver 10 includes pin openings 11*a-b* that are configured to receive pins (not shown) which secure the upper receiver to lower receiver 10. Lower receiver 10 generally includes a magazine well 17, a fire control group well 18, and a buffer tube annulus 12. Magazine well 17 is located at a front end of lower receiver 10 while buffer tube annulus 12 is located at a rear of lower receiver 10. Fire control group well 18 is located between buffer tube annulus 12 and magazine well 17.

Buffer tube annulus or threaded annulus 12 has a front side and a rear side. An opening 14 extends through annulus 12 from the front side to the rear side thereof. Such opening 14 is internally threaded such that one or more threads 16 helically extends along a length of opening 14. Buffer tube annulus 12 is commonly used to engage and secure buffer tube 60 thereto such that buffer tube 60 extends rearward from lower receiver 10. Threads 16 have a right-handed twist such that an object (e.g., buffer tube) engaging such threads 16 from the rear side of annulus 12 advances in a frontward direction upon clockwise rotation.

Figure 2A:
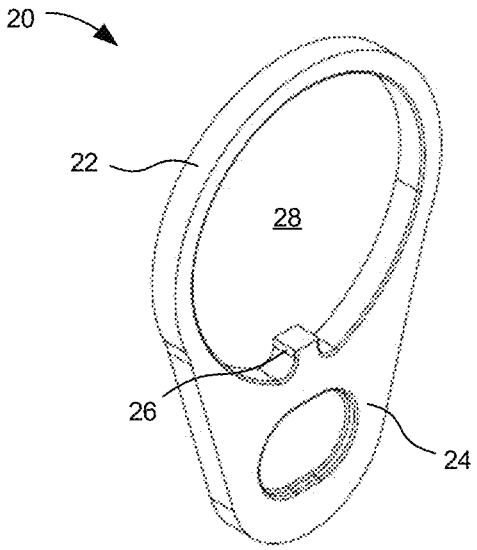
FIG. 2A is perspective view of the receiver endplate of FIG. 1A according to an embodiment of the disclosure.
Figure 2B:
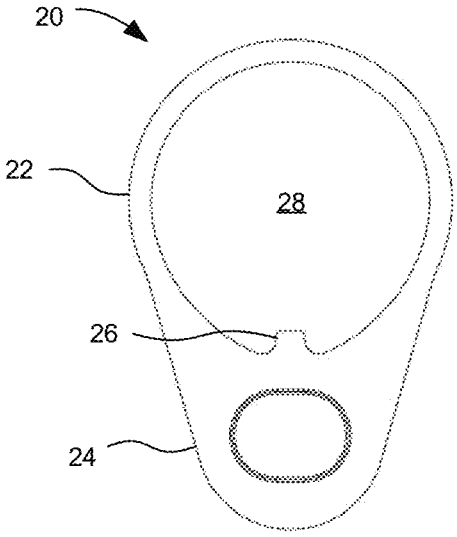
FIG. 2B is an elevational view of the receiver endplate of FIG. 2A.

FIGS. 2A and 2B depict receiver endplate 20 for the firearm according to an embodiment of the present disclosure. Endplate 20 includes a plate body 24 and an annulus 22 extending upward from plate body 24. An opening 28 extends through annulus 22 which, as shown, has a circular profile. A tab or projection 26 extends from plate body 24 into opening 28. Endplate 20 is representative of endplates commonly found in AR-15 style platforms. Such endplates may come stock with the firearm or may be provided separately as an upgrade, modification, or replacement. An endplate is typically mounted to a rear of lower receiver 10, as described in more detail below, and helps contain internal components within lower receiver 10. However, some commonly available endplates, which are not described here, have additional features, such as sling attachments, to provide further functionality. Therefore, it should be understood that endplate 20 can include these additional features and thus can be any endplate known in the art.

Figure 3A:
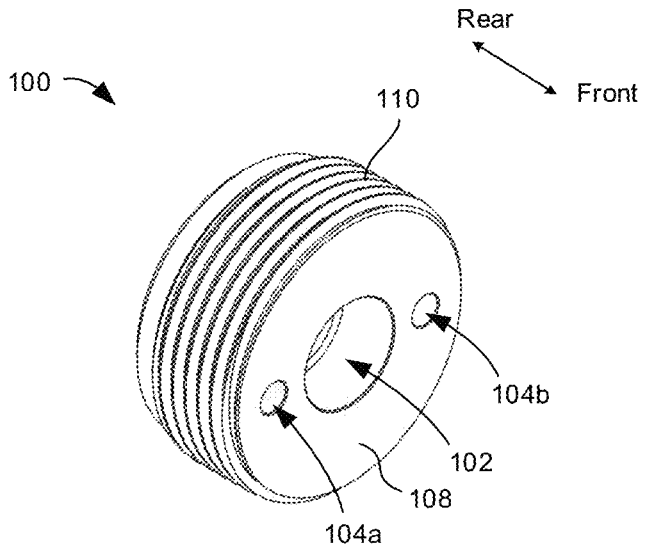
FIG. 3A is a front perspective view of a base of a modular system according to an embodiment of the present disclosure.
Figure 3B:
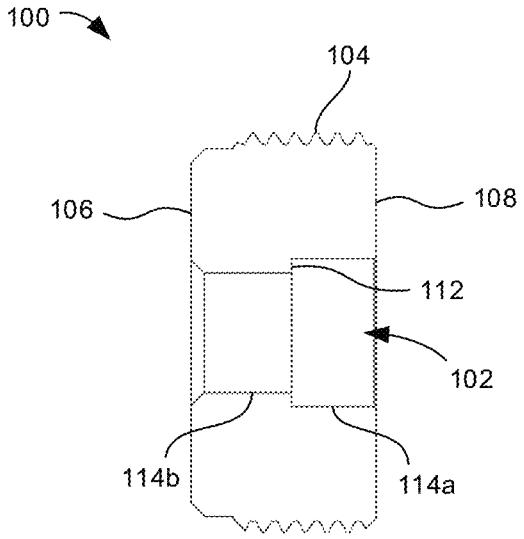
FIG. 3B is a cross-sectional view of the base of FIG. 3A taken along a midline thereof.
Figure 4A:
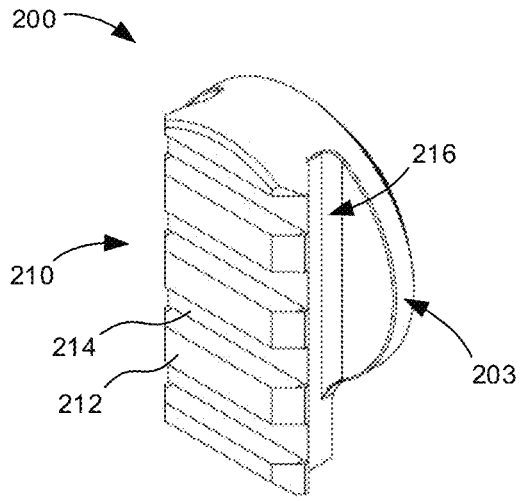
FIG. 4A is a rear perspective view of an end cap of the modular system according to an embodiment of the present disclosure.
Figure 4B:
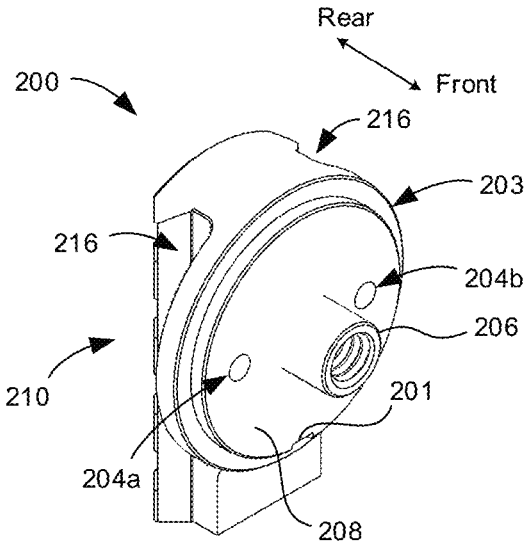
FIG. 4B is a front perspective view of the end cap of FIG. 4A.
Figure 4C:
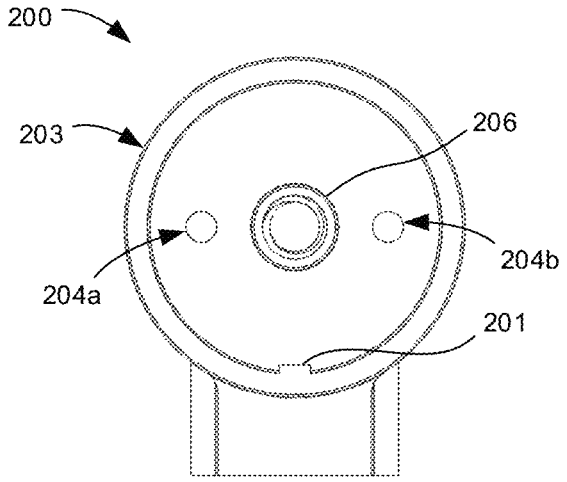
FIG. 4C is a front elevational view of the end cap of FIG. 4A.
Figure 4D:
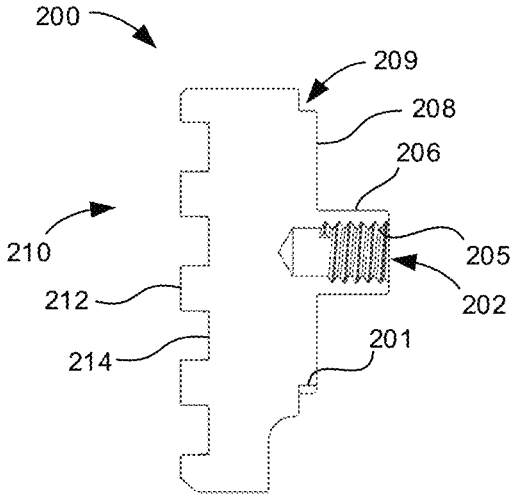
FIG. 4D is a cross-sectional view of the end cap of FIG. 4A taken along a midline thereof.
Figure 5A:
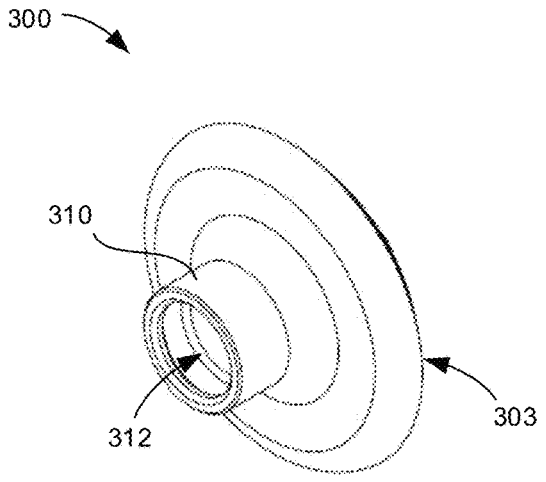
FIG. 5A is a rear perspective view of an end cap of the modular system according to another embodiment of the present disclosure.
Figure 5B:
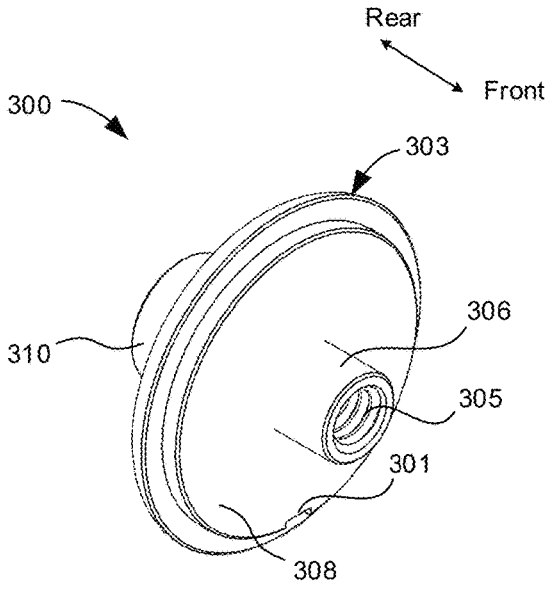
FIG. 5B is a front perspective view of the end cap of FIG. 5A.
Figure 5C:
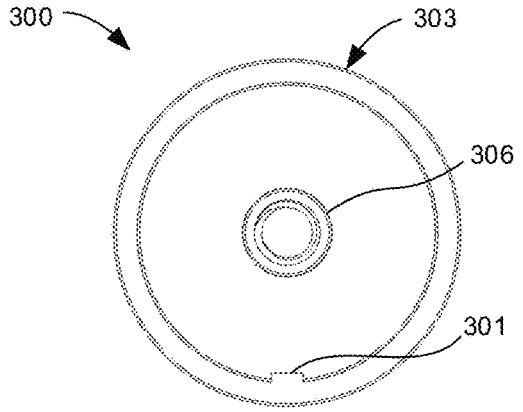
FIG. 5C is a front elevational view of the end cap of FIG. 5A.
Figure 5D:
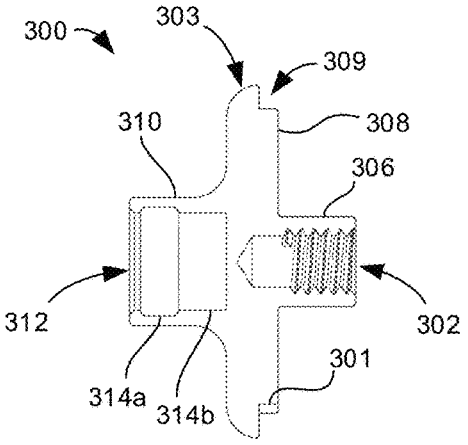
FIG. 5D is a cross-sectional view of the end cap of FIG. 5A taken along a midline thereof.
Figure 6A:
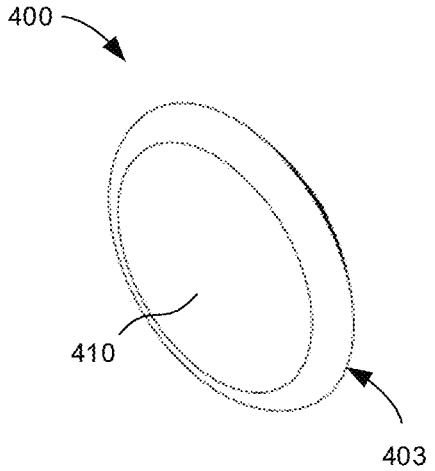
FIG. 6A is a rear perspective view of an end cap of the modular system according to a further embodiment of the present disclosure.
Figure 6B:
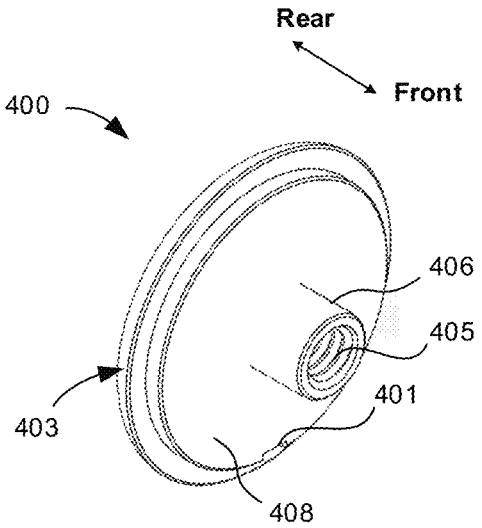
FIG. 6B is a front perspective view of the end cap of FIG. 6A.
Figure 6C:
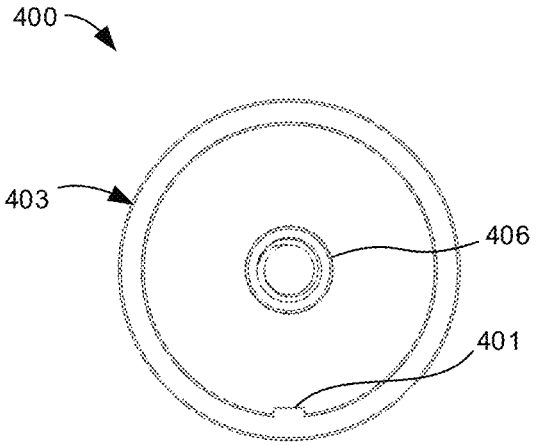
FIG. 6C is a front elevational view of the end cap of FIG. 6A.
Figure 6D:
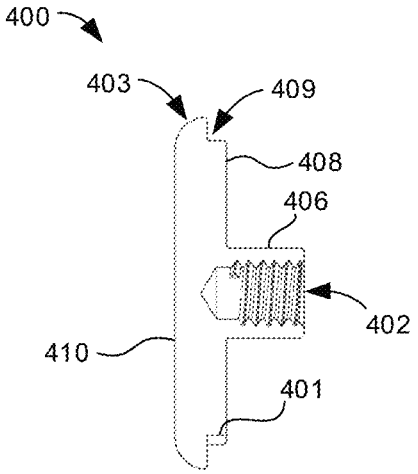
FIG. 6D is a cross-sectional view of the end cap of FIG. 6A taken along a midline thereof.

FIGS. 3A and 3B depict a base 100 of a modular system for the firearm according to an embodiment of the present disclosure. Base 100 is generally cylindrical and has a front face 108, a rear face 106, and at least one external thread 110 helically extending along at least a portion of a length of base 100 between rear and front faces 106, 108. Base 100 also includes a screw opening 102 and a plurality of pin openings 104*a-b*.

Screw opening 102 extends entirely through base 100 from front face 108 to rear face 106 and is a counterbore such that opening 102 has a first portion 114*a* and a second portion 114*b*. First portion 114*a* has a larger cross-sectional dimension than second portion 114*b*. Such difference in cross-sectional dimension forms a shoulder 112 for abutment with a screw head or washer. First portion 114*a* is positioned closer to front face 108 than second portion 114*b*. In the embodiment depicted, screw opening 102 is threadless. However, in other embodiments, screw opening 102 may include threads within first portion 114*a* and/or second portion 114*b* for engagement with a either a threaded screw shank and/or threaded screw head.

Pin openings 104*a-b* flank screw opening 102 and also extend entirely through base 100. Pin openings 104*a-b* are generally smooth bores. However, in some embodiments, openings 104*a-b* may be threaded openings for engagement with a screw. The depicted embodiment includes two pin openings 104*a-b*. However, base 100 may also include one pin opening 104 or more than two pin openings 104, such as three or four pin openings 104.

FIGS. 4A-4D depict a first end cap or Picatinny end cap 200 according to an embodiment of the present disclosure. End cap 200 generally includes a body 203, a screw boss 206, and an accessory means 210. Body 203 is substantially disc-shaped and has a front face 208, which is generally circular, located at a front side of body 203. A circumferential recess or groove 209 is formed in a perimeter of body 203 and intersects front face 208 such that front face 208 has a maximum cross-sectional dimension smaller than a maximum cross-sectional dimension of body 203. In other words, body 203 has a diameter larger than a diameter of front-face 208. A notch 201 extends into body 203 and into front face 208 from circumferential groove 209. Notch 201 is configured to receive tab 26 of endplate 20. In this regard, notch 201 is located at the same position as tab 26 is located on endplate 20 which, in the embodiment depicted, is at the six o'clock position. The diameter of front face 208 is also dimensioned to be received within opening 28 of endplate 20.

Screw boss 206 extends in a frontward direction from front face 208 and is configured to be received within screw opening 102 of base 100. In other words, a diameter of boss 206 is slightly smaller than that of second portion 114*b* of screw opening 102 of base 100 so that boss 206 can be received within base 100. Boss 206 has a threaded opening 202 extending therein. Threaded opening 202 includes one or more inner threads 205 which are configured to threadedly engage threaded shank 44 of screw 40. Threaded opening 202 is a blind opening and, as such, extends into end cap 200 but does not extend entirely through end cap 200. In other words, threaded opening terminates within body 203 of end cap 200.

A plurality of pin openings 204*a-b* extend into front face 208 in a rearward direction from front face 208. Pin openings 204*a-b* are also blind openings in that they terminate within end cap 200 and do not extend all the way through it. Pin openings 204*a-b* are generally smooth bores. However, in some embodiments, they can be threaded bores configured to engage screws rather than pins. The depicted embodiment includes two pin openings 204*a-b*. However, more or less pin openings 204 are contemplated and is generally dependent on how many pin openings 104 are included in base 100. Pin openings 204*a-b* are aligned on a horizontal axis. However, pin openings 204*a-b* can have different orientations, although a horizontal orientation is preferred.

Accessory means 210 is a Picatinny rail. Picatinny rail 210 is located at a rear side of body 203 and is integral with it such that body 203 and Picatinny rail 210 form a monolithic structure. Picatinny rail 210 is a vertical array of horizontally oriented rails 214 interrupted by horizontal grooves 212. In addition, vertical grooves 216 extend in a vertical orientation between body 203 and rails 214. This allows an accessory, such as a buttstock and the like, to be mounted to Picatinny rail 210 by clamping onto it and interdigitating within grooves 214 so as to prohibit translation.

FIGS. 5A-5D depict a second end cap or quick detach ("QD") end cap 300 according to a further embodiment of the present disclosure. End cap 300 generally includes a body 303, screw boss 306, and an accessory means 310. Body 303 is substantially disc-shaped and has a front face 308, which is generally circular, located at a front side of body 303. A circumferential recess or groove 309 is formed in a perimeter of body 303 and intersects front face 308 such that front face 308 has a maximum cross-sectional dimension smaller than a maximum cross-sectional dimension of body 303. In other words, body 303 has a diameter larger than a diameter of front-face 308. A notch 301 extends into body 303 and into front face 308 from circumferential groove 309. Notch 301 is configured to receive tab 26 of endplate 20. In this regard, notch 301 is located at the same position as tab 26 is located on endplate 20 which, in the embodiment depicted, is at the six o'clock position. The diameter of front face 308 is also dimensioned to be received within opening of endplate 28.

Screw boss 306 extends in a frontward direction from front face 308 and is configured to be received within screw opening 102 of base 100. In other words, a diameter of boss 306 is slightly smaller than that of second portion 114*b* of screw opening 102 of base 100 so that boss 306 can be received within base 100. Boss 306 has a threaded opening 302 extending therein. Threaded opening 302 includes one or more inner threads 305 which are configured to threadedly engage threaded shank 44 of screw 40. Threaded opening 302 is a blind opening and, as such, extends into end cap 300 but does not extend entirely through end cap 300. Thus, threaded opening 302 terminates within body 303 of end cap 300.

Accessory means 310 is a QD adapter or accessory boss 310. Accessory boss 310 extends rearward from body 303 and includes an accessory opening 312 therein. Such opening 312 has a first portion 314*a* and a second portion 314*b*. First portion 314*a* has a cross-sectional dimension larger than that of second portion 314*b*. Such difference in cross-sectional dimension facilitates quick detachment with an accessory, such as a QD sling mount, which may quickly attach and detach to accessory boss 310 via a ball-detent mechanism, for example.

FIGS. 6A-6D depict a third end cap or blank face end cap 400 according to yet another embodiment of the present disclosure. End cap 400 generally includes a body 403 and screw boss 406. Body 403 is substantially circular or disc shaped and has front face and a rear face 410. Rear face 410 is a sheer face or blank face which may be planar and includes no interruptions in its surface. A circumferential recess or groove 409 is formed in a perimeter of body 403 and intersects front face 408 such that front face 408 has a maximum cross-sectional dimension smaller than a maximum cross-sectional dimension of body 403. In other words, body 403 has a diameter larger than a diameter of front-face 408. A notch 401 extends into body 403 and into front face 408 from circumferential groove 409. Notch 401 is configured to receive tab 26 of endplate 20. In this regard, notch 401 is located at the same position as tab 26 is located on endplate 20 which, in the embodiment depicted, is at the six o'clock position. The diameter of front face 408 is also dimensioned to be received within opening 28 of receiver endplate 20.

Screw boss 406 extends in a frontward direction from front face 408 and is configured to be received within screw opening 402 of base 400. In other words, a diameter of boss 406 is slightly smaller than that of second portion 114*b* of screw opening 102 of base 100 so that boss 406 can be received within base 100. Boss 406 has a threaded opening 402 extending therein. Threaded opening 402 includes one or more inner threads 405 which are configured to threadedly engage threaded shank 44 of screw 40. Threaded opening 402 is a blind opening and, as such, extends into end cap 400 but does not extend entirely through end cap 400. Thus, threaded opening 402 terminates within body 403 of end cap 400.

As previously described, a firearm, such an AR-15 and the like, can be modified so as to render buffer tube 60 non-functional allowing for its removal from a lower receiver, such as lower receiver 10. As described below, the foregoing devices can comprise a modular system that can be mounted to lower receiver 10 in lieu of buffer tube 60 allowing lower receiver 10 to be configured in various ways not previously possible. In this regard, the system may include base 100 and first end cap 200, second end cap 300, and/or third end cap 400. In addition, the system may include endplate 20. As described in further detail below, base 100 may be connected to annulus 12 of the lower receiver 10. Base 100 facilitates the connection of any one of endplates 200, 300, 400 to lower receiver. Thus, a user has the ability to use the system to quickly and easily reconfigure lower receiver 10 to a desired configuration. As described below, lower receiver 10 has three general configurations corresponding to each end cap 200, 300, 400. However, other configurations are possible as end caps 200, 300, and 400 are exemplary and are not intended to be exhaustive of all possible end cap structures. Moreover, as previously mentioned, various endplates other than endplate 20, which may be commercially available, can be utilized in conjunction with base 100 and end caps 200, 300, 400 so as to provide further possible configurations.

Figure 7A:
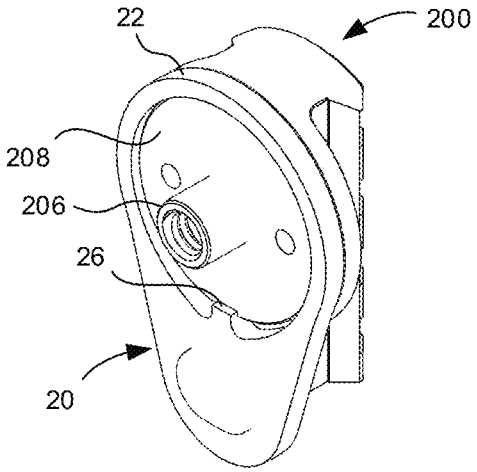
FIG. 7A is a front perspective view of an assembly including the receiver endplate of FIG. 2A and the end cap of FIG. 4A.
Figure 7B:
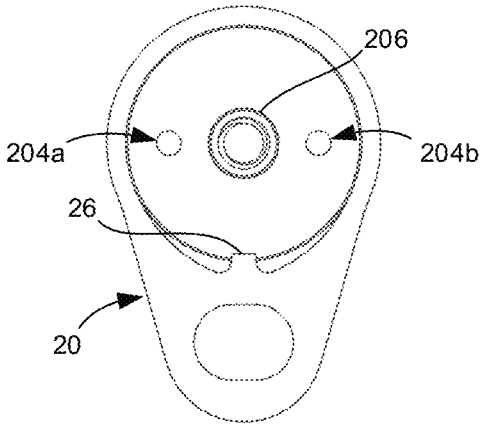
FIG. 7B is a front elevational view of the assembly of FIG. 7A.
Figure 7C:
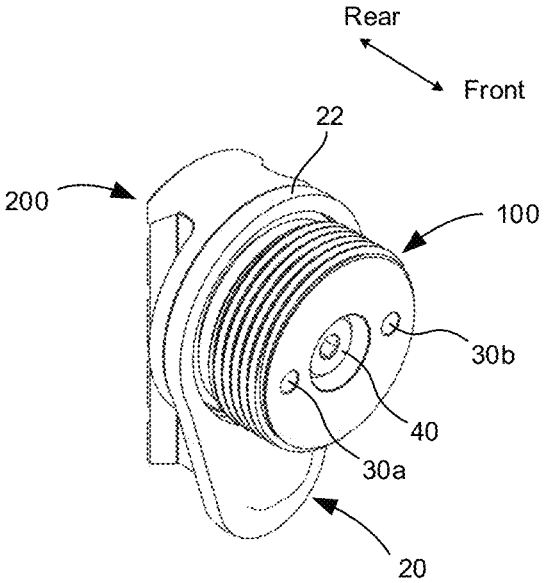
FIG. 7C is a front perspective view of an assembly including the assembly of FIG. 7A and the base of FIG. 3A.
Figure 7D:
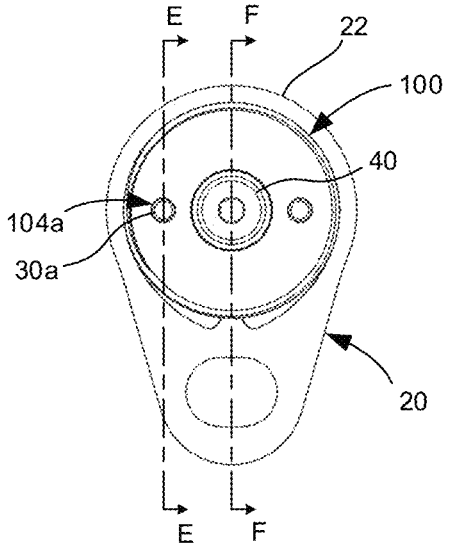
FIG. 7D is a front elevational view of the assembly of FIG. 7C.
Figure 7E:
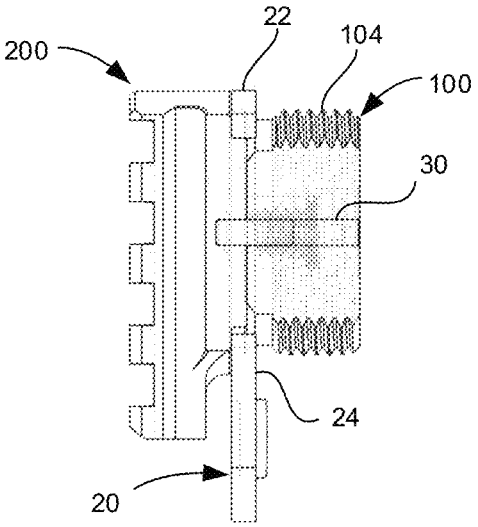
FIG. 7E is a cross-sectional view taken along line E-E of FIG. 7D.
Figure 7F:
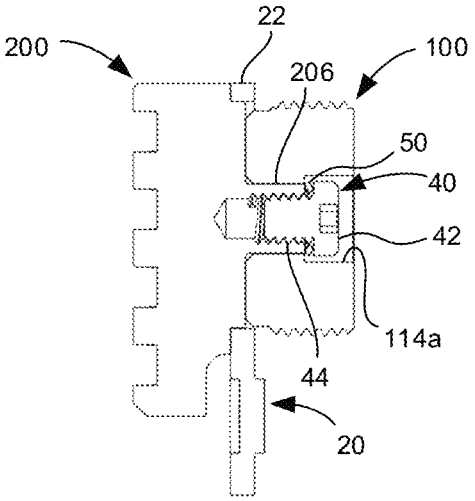
FIG. 7F is a cross-sectional view taken along line F-F of FIG. 7D.

FIGS. 7A-7F depict an assembly of base 100, endplate 200, and first end cap 100. Such assembly is illustrative of similar assemblies using second and third end caps 300, 400. In the assembly, front face 208 of end cap 200 is received within opening 28 of endplate such that tab 26 of endplate 20 is received within notch 201, and annulus 22 of endplate 20 is received within circumferential groove 209, as best shown in FIGS. 7A and 7B. Notch 201 and tab 26 engagement creates a clocking mechanism which ensures a desired orientation of end cap 200 when mounted to lower receiver 10. Threaded boss 206 is received within second portion 114*b* of screw opening 102 of base 100 and a screw 40 is threadedly engaged to boss 206, as best shown in FIG. 7F. A Bellville or thrust washer 50 and a head 42 of screw 40 are positioned within first portion 114*a* of screw opening 102 of base 100. Dowel pins 30 extend through pin openings 104*a-b* in base 100 and into pin openings 204*a-b* in end cap 200, as best shown in FIG. 7E. Such dowel pins 30 provide torsional resistance to ensure end cap 200 remains in a desired rotational orientation.

Figure 8:
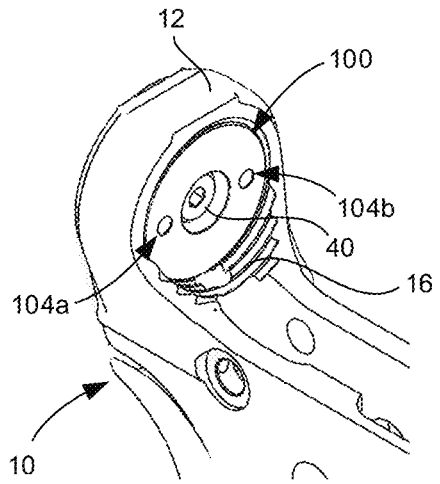
FIG. 8 is an assembly of the lower receiver of FIG. 1B and base of FIG. 3A.

FIGS. 8-11 depict various configurations of lower receiver 10 using the system described herein and methods of assembling the same. With the lower receiver 10 disassembled from an upper receiver and buffer tube 60 removed from lower receiver 10, base 100 is inserted into threaded annulus 12 of lower receiver 10 so that external threads 110 of base 100 engage threads 16 of annulus 12, as shown in FIG. 8. In this regard, base 100 is inserted into annulus 12 from the rear side of annulus 12 and rotated in a clockwise fashion which advances base 100 in a frontward direction. When the base 100 is fully seated, pin openings 104*a-b* are arranged in a horizontal orientation and front face 108 is generally flush with threaded annulus 12. Base 100 may now be utilized to connect any one of end caps 200, 300, 400 to lower receiver 10.

Figure 9:
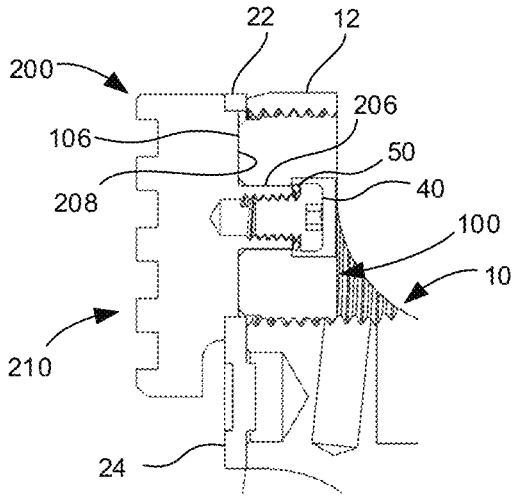
FIG. 9 is a cross-sectional view of an assembly including the assembly of FIG. 8 and end cap of FIG. 4A and taken along a midline thereof.

In a first configuration of lower receiver 10, as shown in FIG. 9, first end cap 200 with endplate 20 mounted thereto is placed against the rear of lower receiver 10 so that threaded boss 206 is received within screw opening 102 of base 100, front face 208 of end cap 200 abuts rear face 106 of base 100, plate body 24 extends downward and adjacent to a lower rear portion of lower receiver 10, and plate annulus 22 is positioned between lower receiver annulus 12 and first end cap 200 which secures endplate 20 in place. Screw 40 is advanced through base 100 and into threaded boss 206 from the front side of base 100 and toward the rear side of base 100. Screw 40 is advanced until head 42 is seated within first portion 114*a* of screw opening 102. As shown, a Bellville or thrust washer 50 may also be used with screw 40. Dowel pins 30 are inserted through pin openings 104*a-b* of base 100 and into pin openings 204*a-b* of first end cap 200 to further secure end cap to base, as illustrated in FIG. 7E. In this configuration, Picatinny rail 210 is positioned at a rear of lower receiver 10 and extends in a vertical orientation which is ensured by the clocking mechanism, base 100, and dowel pins 30. In this regard, end cap 200 is firmly secured so that accessories, such as folding buttstocks and the like, can be connected to Picatinny rail 210.

Figure 10:
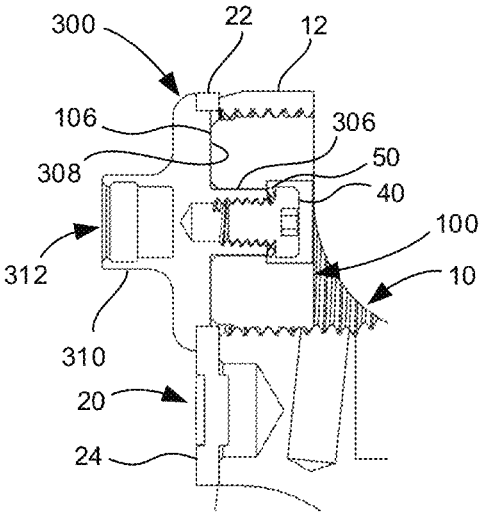
FIG. 10 is a cross-sectional view of an assembly including the assembly of FIG. 8 and end cap of FIG. 5A and taken along a midline thereof.
Figure 11:
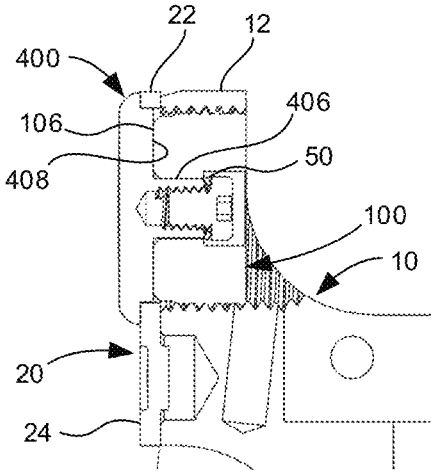
FIG. 11 is a cross-sectional view of an assembly including the assembly of FIG. 8 and end cap of FIG. 6A and taken along a midline thereof.
Figure 12A:
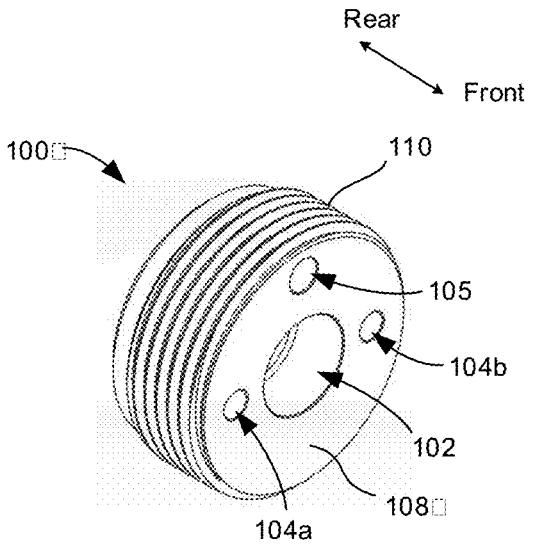
FIG. 12A is a front perspective view of a base of the modular system according to another embodiment of the present disclosure.
Figure 12B:
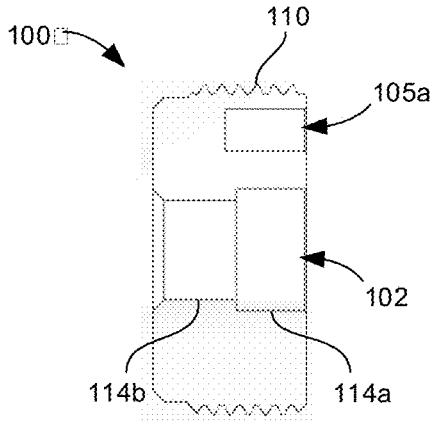
FIG. 12B is a cross-sectional view of the base of FIG. 12A taken along a midline thereof.
Figure 12C:
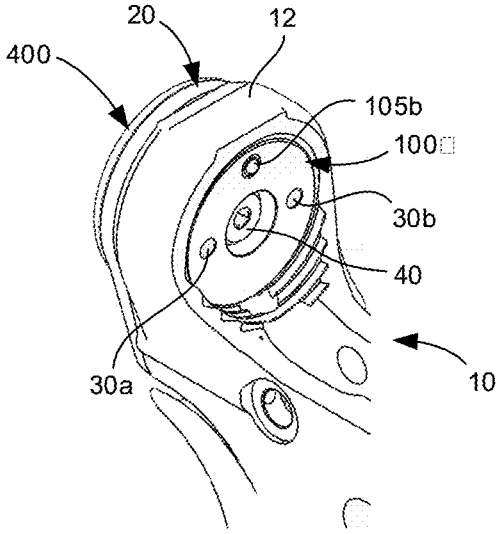
FIG. 12C is an assembly of the lower receiver of FIG. 1B, receiver endplate of FIG. 2A, end cap of FIG. 6A, and base of FIG. 12A.
Figure 12D:
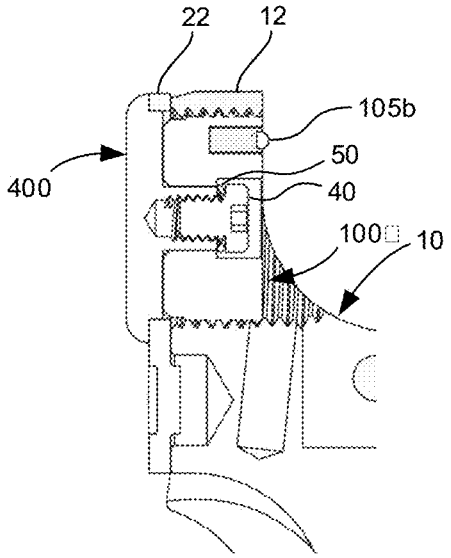
FIG. 12D is a cross-sectional view of the assembly of FIG. 12C taken along a midline thereof.

If so desired, a user may easily remove first end cap 200 and swap it out with second or third end cap 300, 400. In this regard, second end cap 300 may be connected to base 100 in a second configuration, as shown in FIG. 10. In this configuration, base 100 is disposed within threaded annulus 12 and end cap 300 is connected to base 100 via screw 40. In this regard, threaded boss 406 is positioned within screw opening 102, just as in the first configuration, and rear face 106 of base 100 abuts front face 308 of second end cap 300. It is noted that in this configuration, dowel pins 30 are not used. However, in some embodiments, second end cap 300 may also have pin openings for dowel pins 30. Endplate 20 is also secured by being sandwiched between second end cap 300 and lower receiver 10. In this regard, annulus 22 of endplate 20 is received within circumferential groove 309 of end cap 300 and front face 308 of end cap 300 is disposed within annulus 22. In this second configuration, a QD sling or the like may be connected to accessory boss 310.

The third configuration is similar to the first and second with the difference being that third end cap 400 is connected to base 100 rather than first or second end caps 200, 300.

Thus, as shown, boss 406 is positioned within screw opening 102, and rear face of base 106 abuts front face 408 of third end cap 400. It is noted that in this configuration, dowel pins 30 are also not utilized. However, in some embodiments, third end cap 400 may also have pin openings for dowel pins 30. Endplate 20 is also secured by being sandwiched between third end cap 400 and lower receiver 20. In this regard, annulus 22 of endplate 20 is received within circumferential groove 409 of end cap 400 and front face 408 of end cap 400 is disposed within annulus 22. While no accessory may be attached directly to third end cap 400, third end cap 400 provides an aesthetically pleasing end of lower receiver 10. Also, because base 100 and third end cap 400 may be utilized in conjunction with endplate 400, endplate 400 may itself be configured to receive an accessory, such as a sling. Thus, the system described herein provides several options to a user.

In addition to that described above, the system is advantageous in that base 100 is connected to any one of the end caps 200, 300, 400 without screw 40 having to penetrate through a rear side of any one of such end caps 200, 300, 400. This not only keeps the rear sides of the end caps 200, 300, 400 blemish free, but also allows for end caps 200, 300, 400, such as second end cap 300, to be connected to base 100 where such connection might otherwise not be possible. For example, second end cap 300 does not have any available real estate at its rear side for a screw opening as it is not practicable to insert screw 40 through accessory boss 310 and not optimal to insert screws through any other location on end cap 300.

Various kits may be provided with one or more of the components previously described herein. For example, a kit may include base 100 and first end cap 200, second end cap 300, and/or third end cap 400. Such kit may also include washer 50, screw 40, dowel pins 30, and/or endplate 20. However, it is noted that endplate 20 may be separately provided as such endplate 20 is commonly provided as a stock item with lower receiver 10. However, the kit may provide a replacement or upgraded endplate.

FIGS. 11A-11E depict base 100' according to an embodiment of the present disclosure. Base 100' is the same as base 100 with the exception that base 100' includes a ball-detent 105*b*. Ball-detent 105*b* is positioned within a ball-detent bore 105*a* that extends into front face 108' of base 100'. In this regard, ball-detent 105*b* projects out of bore 105*a* and protrudes slightly frontward of front face 108', as best shown in FIG. 11D. Ball detent 105*b* is preferably located at a twelve o'clock position on front face 10, but other positions, such as a six o'clock position, are contemplated. When an upper receiver with a bolt carrier group, such as a .22 LR bolt carrier, are connected to lower receiver 10, ball detent 105*b* may apply pressure the bolt carrier group positioned adjacent to base so as to limit undesired movement during operation.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A modular system for a firearm receiver having a threaded annulus at a rear end thereof, the modular system comprising:

a base having a front face, a rear face, and a thread helically extending along an exterior thereof between the front face and rear face and configured to engage with the threaded annulus of the receiver, the base having a screw opening extending through the front and rear faces;

a first end cap having a body, the body having a front face and a threaded opening extending into the body and terminating therein; and a screw having a threaded shank configured to extend through the screw opening of the base and into the threaded opening of the first end cap for connecting the base and the first end cap.

2. The system of claim 1, wherein the screw opening is smooth bore having a first portion and a second portion, the second portion having a cross-sectional dimension smaller than the first portion.

3. The system of claim 1, wherein the base includes a pin opening extending therethrough from the front face to the rear face.

4. The system of claim 3, wherein the first end cap includes a pin opening extending into the body from the front face thereof and terminating within the body, the pin opening of the first end cap configured to align with the pin opening of the base when the base and first end cap are connected by the screw.

5. The system of claim 1, wherein the body of the first end cap is disc shaped and the front face of the first end cap has a maximum diameter smaller than a maximum diameter of the body so as to form a circumferential recess in a perimeter of the body.

6. The system of claim 5, further comprising an endplate having a plate body and a plate annulus extending from the plate body, the plate annulus being receivable in the circumferential recess of the body of the first end cap and defining a plate opening configured to receive the front face of the first end cap.

7. The system of claim 6, wherein the first end cap includes a notch extending into the body and front face thereof, and the endplate includes a tab extending into the plate opening, the tab being receivable within the notch.

8. The system of claim 1, wherein the first end cap includes a boss extending from the front face thereof, the threaded opening extending into the boss.

9. The system of claim 1, further comprising a second end cap having a body, the body of the second end cap having a front face and a threaded opening extending into the body of the second end cap and terminating therein, wherein the first end cap includes a Picatinny rail extending from a rear of the body of the first end cap, and the second end cap includes an accessory boss extending from a rear of the body of the second end cap.

10. The system of claim 9, further comprising a third end cap having a body, the body of the third end cap having a front face and a threaded opening extending into the body of the third end cap and terminating therein, the body of the third end cap having a sheer rear face.

11. The system of claim 1, wherein the base includes a ball-detent projecting from the front face thereof.

12. A modular system for a firearm receiver having a threaded annulus at a rear end thereof, the modular system comprising:

a base having a front face, a rear face, and a thread helically extending along an exterior thereof between the front face and rear face and configured to engage with a threaded annulus of a firearm receiver, the base having a through opening extending through the front and rear faces; and a first end cap having a front side and a rear side, the front side having a blind opening extending into the first end cap from the front side and terminating within the first end cap, wherein the base and first end cap are connectable via one of a screw and pin extending through the through opening of the base and into the blind opening of the first end cap, wherein the through opening is a counterbore and the blind opening is a threaded opening.

13. The system of claim 12, wherein the through opening and blind opening are each smooth bores.

14. The system of claim 12, wherein the first end cap includes a body having a front face and a boss extending from the front face, the blind opening extending into the boss.

15. The system of claim 14, wherein the through opening of the base has a first portion and a second portion, the first portion being closer to the front face of the base than the second portion, the second portion having a smaller cross-sectional dimension than the first portion and being dimensioned to receive the boss therein.

16. The system of claim 12, wherein the first end cap includes a Picatinny rail disposed at the rear side thereof.

17. The system of claim 16, further comprising a second end cap having a front side and a rear side, the front side of the second end cap having a blind opening extending into the second end cap from the front side and terminating within the second end cap, the rear side of the second end cap having an accessory boss and an accessory opening extending therein.

18. The system of claim 12, further comprising an end plate having a plate body and a plate annulus, wherein the front side of the first end cap has a front face configured to be received within the plate annulus and a circumferential groove configured to receive the plate annulus.

19. A modular system for a firearm receiver having a threaded annulus at a rear end thereof, the modular system comprising:

a base having a front side, a rear side, and a thread helically extending along an exterior thereof between the front side and rear side and configured to engage with a threaded annulus of a firearm receiver;

a first end cap having a front side and a rear side, the front side of the first end cap being connectable to the rear side of the base, the rear side of the first end cap having a first accessory means; and a second end cap having a front side and a rear side, the front side of the second end cap being connectable to the rear side of the base, the rear side of the second end cap having a second accessory means, the second accessory means differing from the first accessory means.

* * * * *